United States Patent [19]

Watkin

[11] 4,007,503

[45] Feb. 15, 1977

[54] PILLOW AND CASE OF PHYSIOLOGICALLY ADVANTAGEOUS SHAPE

[76] Inventor: Bernard Currs Watkin, 32 W. Square, London SE. 11, England

[22] Filed: Dec. 11, 1975

[21] Appl. No.: 585,217

[52] U.S. Cl. ..... 5/338

[51] Int. Cl.[2] ..... A47G 9/00

[58] Field of Search ..... 5/339, 337, 334, 338; D6/201, 204, 206

[56] References Cited

UNITED STATES PATENTS

| | | | |
|---|---|---|---|
| 1,876,591 | 9/1932 | Bawden | 5/339 |
| 2,779,033 | 1/1957 | Fountain | 5/339 |
| D126,825 | 4/1941 | Kolisch | D6/201 |

FOREIGN PATENTS OR APPLICATIONS

| | | | |
|---|---|---|---|
| 15,112 | 11/1887 | United Kingdom | 5/339 |

OTHER PUBLICATIONS

"Your Rights in Bed," p. 17, Tuck in Pillow, 1957, Norman Dine Sleep Center, N.Y., N.Y.

Norman Dine Sleep Center, p. 27, — "Modern Dutch Pillow.×

*Primary Examiner*—Paul R. Gilliam

*Assistant Examiner*—A. Calvert

*Attorney, Agent, or Firm*—Kenneth S. Goldfarb

[57] ABSTRACT

A pillow case comprising first and second walls of flexible material each having a shape symmetrical about is center line.

The center of the pillow case is narrower than the ends to form a generally butterfly shape.

1 Claim, 2 Drawing Figures

FIG. 1
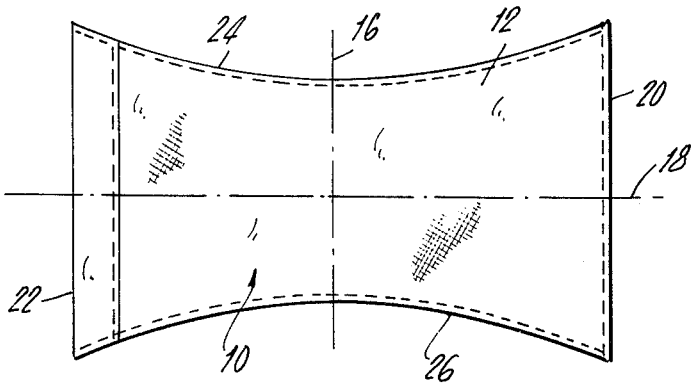
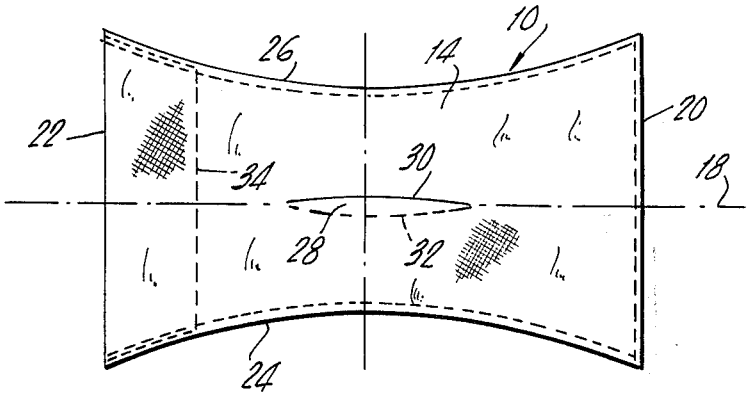
FIG. 2

PILLOW AND CASE OF PHYSIOLOGICALLY ADVANTAGEOUS SHAPE

BACKGROUND OF THE INVENTION

1. Field of the Invention

This invention relates to pillows and more particularly to a therapeutic pillow and pillow case.

2. Description of the Prior Art

Known pillows comprise a fabric case of rectangular shape containing a suitable filling material. It is found that such pillows do not give the optimum support to the head and neck of the user, and can cause complaints such as neckache in the user.

SUMMARY OF THE INVENTION

According to this invention there is provided a pillow case comprising first and second walls of flexible material each having a shape which is symmetrical about a centre line in the plane of the wall and whose width measured in a direction parallel to the centre line between opposite edges of the wall increases with increasing distance from the centre line measured in a longitudinal direction perpendicular to the centre line, the first and second walls being joined to one another at least along the said edges of the walls.

Preferably each of the two walls has a shape which is symmetrical also about a line lying in the plane of the wall and perpendicular to the centre line.

Advantageously, one wall of the pillow case has a width at the centre line somewhat less than that of the other wall.

Suitably, each wall is bounded by the said longitudinal edges and by two straight transverse edges parallel to the centre line, the walls being joined together along one of the transverse edges of each wall, the remaining transverse edges defining an open mouth through which a pillow can be inserted into the pillow case.

Suitably, each wall is formed separately from fabric material, the two walls being sewn together along their joined edges.

The invention also includes a pillow comprising a pillow case as defined above, containing a filling of resilient material, the two walls of the pillow case being joined together around the whole of their peripheral edges.

One embodiment of the invention will now be described, by way of example, with reference to the accompanying drawing, in which:

BRIEF DESCRIPTION OF THE DRAWING

FIG. 1 is a top plan view of a pillow case constructed in accordance with the invention, and FIG. 2 is an underneath plan view of the pillow case of FIG. 1.

DETAILED DESCRIPTION OF THE INVENTION

The drawing shows a pillow case 10 provided for use with a rectangular shaped pillow of conventional form.

The pillow case is formed from cotton or other suitable fabric, and has upper and lower walls 12 and 14 each having a "butterfly" shape which is symmetrical about a transverse centre line 16 and also about a longitudinal line 18 perpendicular to the centre line 16. The width of the upper wall 12 increases with increasing distance from the centre line 16 to the two straight edges 20 and 22, the two longitudinal edges 24 and 26 joining the straight edges 20 and 22 defining a smooth curve which is convex towards the longitudinal centre line 18 of the wall 12.

The lower wall 14 has a shape of similar dimensions, except that a tube 28 is formed in the wall 14, by gathering a fold in the material of the wall and stitching together the two layers of material along a line 30 spaced from the fold 32, the tuck 28 extending generally along the longitudinal centre line 18 of the wall, and effectively reducing the width of the lower wall 14 at the transverse centre line 16.

Each of the upper and lower walls 12 and 14 is formed from a piece of fabric, the two pieces being joined by stitching along one of the straight edges 20 and the two curved longitudinal edges 24 and 26 of the pillow case, the remaining straight edges 22 of the walls bounding the open mouth of the pillow case.

The dimensions of the two pieces of fabric are such that an adequate seam can be formed along the joined edges of the pieces, and hems formed at the open mouth of the pillow case. The material of the lower wall 14 of the pillow case is folded against itself, at the edge 22 adjacent the open mouth of the pillow case, and extends a few inches into the interior of the pillow case, the edges of the internally extending portion 34 of material being sewn to the adjacent edges 24 and 26 of the pillow case to form a pocket adapted, in use, to receive the end portion of a pillow inserted into the pillow case thereby to hold the pillow and pillow case together.

In use, a pillow of conventional rectangular form and of suitable dimensions is inserted into the pillow case. Because of the shape of the pillow case, the pillow takes up a butterfly shape, having which is relatively small at the tranverse centre line of the pillow and increases towards the ends of the pillow. The pillow in this shape helps to provide better support for the head and neck of the user than does the pillow in its normal rectangular shape.

It will be appreciated that the dimensions of the pillow case given above can be varied to a large extent without losing the advantage of the "Butterfly" shape of the pillow case.

It will also be appreciated that, instead of using the described pillow case with a conventional rectangular pillow, a pillow of the described shape could be made by inserting a suitable filling into a case in the shape of the described pillow case, the open mouth of the case being closed by stitching after the filling has been inserted.

A latitude of modification, substitution and change is intended in the foregoing disclosure, and in some instances, some features of the present invention may be employed without a corresponding use of other features.

What is claimed is:

1. A pillow comprising a pillow case comprising first and second walls of flexible material each having a shape which is symmetrical about a centre line in the plane of the wall and whose width measured in a direction parallel to the centre line between opposite edges of the wall increases with increasing distance from the centre line measured in a longitudinal direction perpendicular to the centre line, the first and second walls being joined to one another at least along the said edges of the walls, each of the walls having a shape which is symmetrical about a line lying in the plane of the each of said walls being separately formed of fabric material wall and perpendicular to the centre line, each wall being bounded by the said longitudinal edges and by two straight transverse edges parallel to the centre line, the walls being joined together along at least one of the transverse edges of each wall, and a filling of rectangular configuration disposed in said pillow case whereby the pillow has a center portion of reduced dimensions under compression forming a relatively hard central area and the outer areas are relatively soft.

* * * * *